US009194561B2

(12) United States Patent
Wu et al.

(10) Patent No.: US 9,194,561 B2
(45) Date of Patent: Nov. 24, 2015

(54) VARIABLE FOCUSLAMP

(71) Applicant: GUANGDONG COSIO LIGHTING CO., LTD., Foshan (CN)

(72) Inventors: Yulin Wu, Foshan (CN); Haifeng Li, Foshan (CN); Ming Liang, Foshan (CN)

(73) Assignee: GUANGDONG COSIO LIGHTING CO., LTD., Foshan (CN)

( * ) Notice: Subject to any disclaimer, the term of this patent is extended or adjusted under 35 U.S.C. 154(b) by 0 days.

(21) Appl. No.: 14/328,686

(22) Filed: Jul. 10, 2014

(65) Prior Publication Data

US 2015/0153025 A1 Jun. 4, 2015

(30) Foreign Application Priority Data

Dec. 2, 2013 (CN) ..... 2013 2 0780512 U

(51) Int. Cl.

| | |
|---|---|
| ***F21V 14/06*** | (2006.01) |
| ***F21V 29/83*** | (2015.01) |
| ***F21S 8/02*** | (2006.01) |
| ***F21V 19/02*** | (2006.01) |
| ***F21V 21/04*** | (2006.01) |
| *F21Y 101/02* | (2006.01) |

(52) U.S. Cl.

CPC ..... *F21V 14/06* (2013.01); *F21S 8/024* (2013.01); *F21S 8/026* (2013.01); *F21V 19/02* (2013.01); *F21V 21/046* (2013.01); *F21V 29/83* (2015.01); *F21Y 2101/02* (2013.01)

(58) Field of Classification Search

CPC ..... F21V 14/06; F21V 14/065; F21V 14/00; F21V 29/74; F21V 29/83; F21V 17/02

USPC ..... 362/187, 277, 280, 281, 319, 322

See application file for complete search history.

(56) References Cited

U.S. PATENT DOCUMENTS

| | | | | |
|---|---|---|---|---|
| 2010/0061076 | A1* | 3/2010 | Mandy et al. | 362/20 |
| 2012/0147606 | A1* | 6/2012 | Huang et al. | 362/277 |

* cited by examiner

*Primary Examiner* — Y M Lee

(74) *Attorney, Agent, or Firm* — Matthias Scholl, PC; Matthias Scholl

(57) ABSTRACT

A lamp including: a casing, a light source, a radiator, a front cover, and a convex lens. The front cover includes: a rotary ring, a movable ring, and a stop ring. An annular groove is disposed outside of the rotary ring. A limiting structure extends inside the annular groove and limits the rotary ring to rotate relative to the casing. The stop ring is fixed inside the rotary ring and the stop ring and the rotary ring combine to form female threads. The movable ring is disposed inside the rotary ring and convex points of the movable ring match with the female threads. Guide columns are disposed on an end part of the movable ring close to the radiator. The guide columns match with guide holes of the radiator and are adapted to axially pass through the guide holes. The convex lens is fixed on the movable ring.

10 Claims, 2 Drawing Sheets

VARIABLE FOCUSLAMP

CROSS-REFERENCE TO RELATED APPLICATIONS

Pursuant to 35 U.S.C. §119 and the Paris Convention Treaty, this application claims the benefit of Chinese Patent Application No. 201320780512.5 filed Dec. 2, 2013, the contents of which are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

1. Field of the Invention

The invention relates to the field of lighting equipment, and more particularly to a variable focus lamp.

2. Description of the Related Art

Variable focus lamps impose high requirements on the accuracy of the optical zoom device. Low accuracy of the device results in the vibration of a convex lens in the process of zooming and the deviation of a light spot.

SUMMARY OF THE INVENTION

In view of the above-described problems, it is one objective of the invention to provide a variable focus lamp that adopts a bicircular rotary focusing mechanism, so that the movement of the convex lens is smooth. The lamp is simple, practical, and convenient for operation.

To achieve the above objective, in accordance with one embodiment of the invention, there is provided a variable focus lamp comprising: a casing provided with a limiting structure; a light source; a radiator provided with guide holes; a front cover, the front cover comprising: a rotary ring provided with an annular groove, a movable ring provided with a plurality of convex points and a plurality of guide columns, and a stop ring; and a convex lens. The light source is fixed on the radiator and disposed inside the casing. The casing is fixed on the radiator. The convex lens is fixed on the front cover, and the front cover is connected to the casing. The annular groove is disposed on an outer side of the rotary ring. The limiting structure extends inside the annular groove and limits the rotary ring to rotate relative to the casing. The stop ring is fixed inside the rotary ring. The stop ring and the rotary ring combine to form a plurality of female threads. The movable ring is disposed on an inner side of the rotary ring and the convex points of the movable ring match with the female threads. The guide columns are disposed on an end part of the movable ring close to the radiator. The guide columns match with the guide holes of the radiator and are adapted to axially pass through the guide holes. The convex lens is fixed on the movable ring.

In a class of this embodiment, the light source is an LED chip.

In a class of this embodiment, the LED chip is fixed on a circuit board and the circuit board is fixed on the radiator. The lamp further comprises a circuit board cover. The circuit board cover covers an outer surface of the circuit board and comprises a chip hole.

In a class of this embodiment, the limiting structure comprises two pointed screws symmetrically distributed on two sides of the casing.

In a class of this embodiment, numbers of the female threads and the convex points are both three; both the female threads and the convex points are uniformly distributed.

In a class of this embodiment, an outer casing is disposed on an outer side of the casing; and the outer casing is provided with torsional spring buckles for installing the lamp.

In a class of this embodiment, the torsional spring buckles are symmetrically distributed on an outer side of the outer casing.

In a class of this embodiment, numbers of the guide holes and the guide columns are both three; and both the guide holes and the guide columns are uniformly distributed.

In a class of this embodiment, the casing, the outer casing, and the radiator are all aluminum materials.

In a class of this embodiment, the front cover is an acrylonitrile butadiene styrene (ABS) material.

Advantages according to embodiments of the invention are summarized as follows:

The front cover of the invention is designed to be a bicircular rotary focusing mechanism, so that the vibration of the convex lenses mounted on the front cover is diminished, the movement thereof is smooth, and the light spot deviation is avoided. The lamp is simple, practical, and convenient for operation.

BRIEF DESCRIPTION OF THE DRAWINGS

The invention is described hereinbelow with reference to the accompanying drawings, in which.

Figure 1:
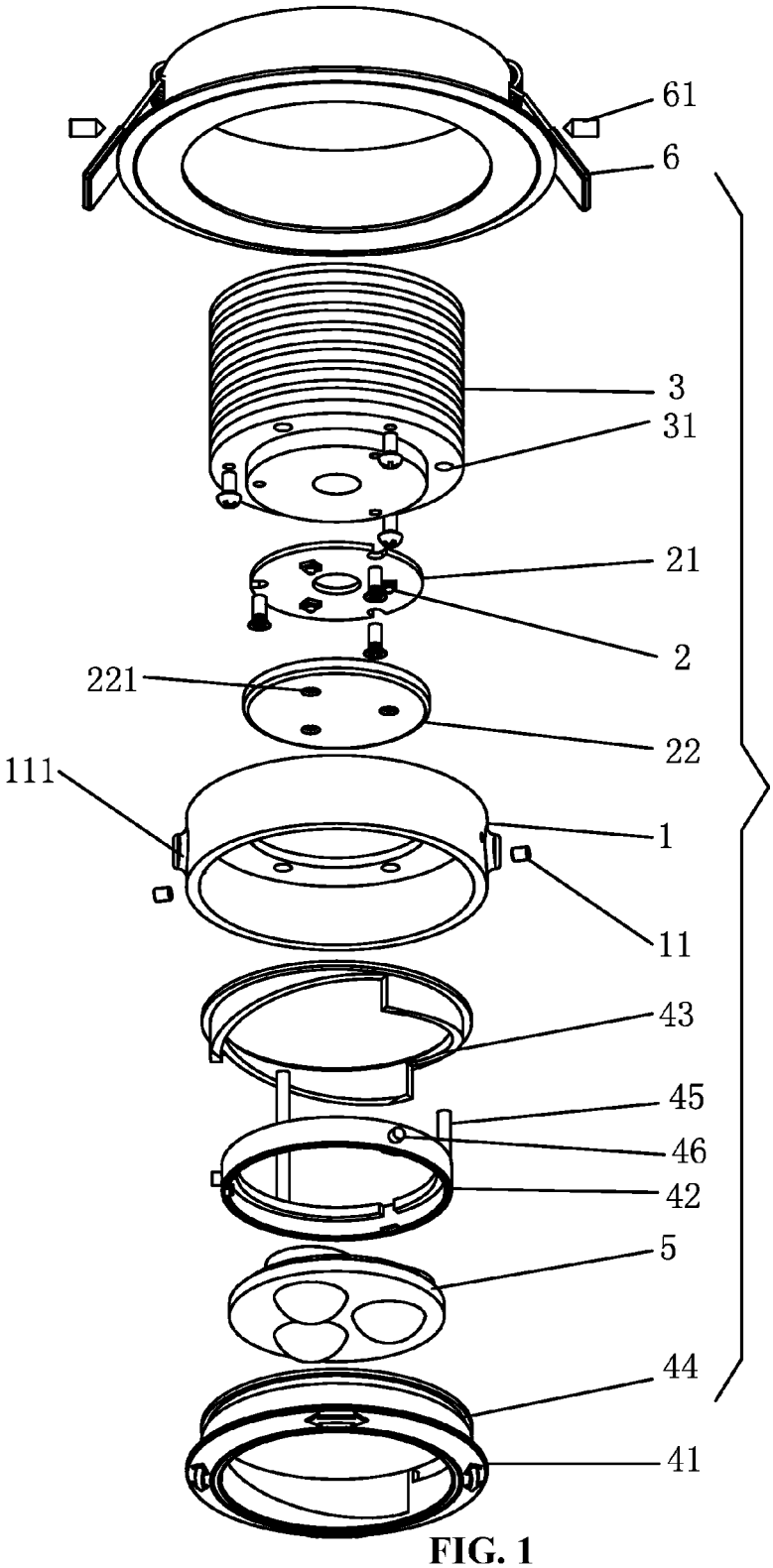
FIG. 1 is an exploded view of a variable focus lamp in accordance with one embodiment of the invention.

In the drawings, the following reference numbers are used: 1. Casing; 11. Pointed screw; 2. Light source; 21. Circuit board; 22. Circuit board cover; 3. Radiator; 31. Guide hole; 41. Rotary ring; 42. Movable ring; 43. Stop ring; 44. Annular groove; 45. Guide column; 46. Convex point; 5. Convex lens; 6. Outer casing; and 61. Torsional spring buckle.

DETAILED DESCRIPTION OF THE EMBODIMENTS

For further illustrating the invention, experiments detailing a variable focus lamp are described below. It should be noted that the following examples are intended to describe and not to limit the invention.

Figure 2:
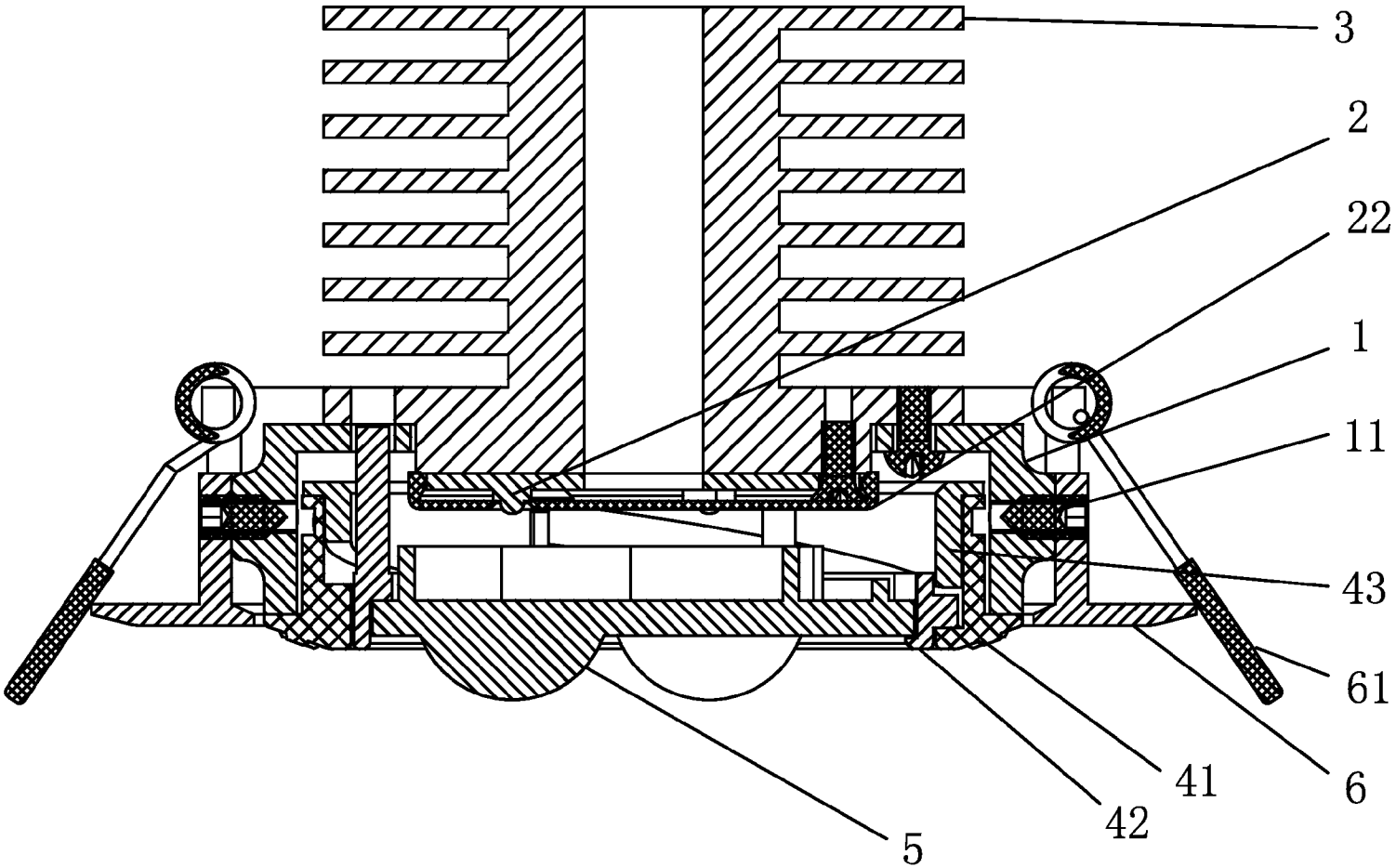
FIG. 2 is a cross-sectional view of a variable focus lamp in accordance with one embodiment of the invention.

As shown in FIGS. 1-2, a variable focus lamp comprises: a casing 1, a light source 2, a radiator 3, a front cover, and a convex lens 5. The light source 2 is fixed on the radiator 3 and disposed inside the casing 1. The casing 1 is fixed on the radiator 3. The convex lens 5 is fixed on the front cover, and the front cover 1 is connected to the casing 1.

As shown in FIGS. 1-2, the front cover comprises: a rotary ring 41, a movable ring 42, and a stop ring 43 in annular structures. An annular groove 44 is disposed on an outer side of the rotary ring 41. The casing 1 comprises a limiting structure that extends inside the annular groove 44 and limits the rotary ring 41 to rotate only relative to the casing 1.

As shown in FIG. 1, the stop ring 43 is fixed inside the rotary ring 41, and the stop ring 43 and the rotary ring 41 combine to form a plurality of female threads. The movable ring 42 is disposed on an inner side of the rotary ring 41 and comprises a plurality of convex points 46 matching with the female threads. An end part of the movable ring 42 close to the radiator 3 comprises a plurality of guide columns 45 that match with guide holes 31 of the radiator 3 and are adapted to axially pass through the guide holes 31, respectively. The convex lens 5 is fixed on the movable ring 42.

The rotary ring is limited by the casing 1 to rotate only relative to the casing 1 due to the copulation of the annular groove 44 and the limiting structure. When the rotary ring 41 rotates, the movable ring 42 moves under the acting force between the convex points 46 and the structure of the female threads. The stop ring 43 is capable of preventing the movable ring 42 from continuously moving towards the radiator 3. The movable ring 42 is limited by the radiator 3 to only transitionally move along an axial direction of the guide column 45 relative to the dissipater 3 due to the copulation of the guide columns 45 and the guide holes 31. The front cover and the casing 1 form a bicircular rotary focusing mechanism. When the rotary ring 41 is rotated, the female threads match with the convex points 46, and the rotary movement of the rotary ring 41 is converted to a transitional movement of the movable ring 42 along the axial direction, so that the distance between the convex lenses 5 and the light source 2 is changed and the purposed of focus adjustment is reached.

The light source 2 is an LED (light-emitting diode) chip. The LED chip is a green light source featuring energy-saving, environment protection, long service life, and small volume.

As shown in FIG. 1, the LED chip is fixed on a circuit board 21 and the circuit board 21 is fixed on the radiator 3. The lamp further comprises a circuit board cover 22. The circuit board cover 22 covers an outer surface of the circuit board 21 and comprises a chip hole 221.

As shown in FIG. 1, the limiting structure comprises two pointed screws 11 symmetrically distributed on an outer side of the casing 1, and comprises two screw holes 111 for respectively receiving the two pointed screws 11. Two support points are capable of supporting the rotary ring 41. Or, the number of the pointed screws 11 is more than two, and the pointed screws 11 is replaced by other structures, such as an annular limiting structure.

As shown in FIG. 1, numbers of the female threads and the convex points 46 are both three, and both the female threads and the convex points are uniformly distributed. The three female threads match with the convex points 46, thereby enabling the movable ring 42 to move smoothly. Or, more than three female threads and more than three convex points 46 match with each other.

As shown in FIGS. 1-2, an outer casing 6 is disposed on the outer side of the casing 1. The outer casing 6 is provided with torsional spring buckles 61 for installing the lamp.

As shown in FIGS. 1-2, the torsional spring buckles 61 are symmetrically distributed outside the outer casing 6.

As shown in FIG. 1, numbers of the guide holes 31 and the guide columns 45 are both three, and both the guide holes 31 and the guide columns 45 are uniformly distributed. Or, both the numbers of the guide holes 31 and the guide columns 45 are more than three.

The casing 1, the outer casing 6, and the radiator 3 are all aluminum materials that have good heat dissipation performance.

The front cover is an ABS (acrylonitrile butadiene styrene) material.

The front cover of the invention is designed to be a bicircular rotary focusing mechanism, so that the vibration of the convex lenses mounted on the front cover is diminished, the movement thereof is smooth, and the light spot deviation is avoided. The lamp is simple, practical, and convenient for operation.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A lamp, comprising:

a) a casing provided with a limiting structure;

b) a light source;

c) a radiator provided with guide holes;

d) a front cover, the front cover comprising: a rotary ring provided with an annular groove, a movable ring comprising a plurality of convex points and a plurality of guide columns, and a stop ring; and e) a convex lens;

wherein the light source is fixed on the radiator and disposed inside the casing; the casing is fixed on the radiator;

the convex lens is fixed on the front cover, and the front cover is connected to the casing;

the annular groove is disposed on an outer side of the rotary ring; the limiting structure extends inside the annular groove and limits the rotary ring to rotate relative to the casing;

the stop ring is fixed inside the rotary ring; the stop ring and the rotary ring combine to form a plurality of female threads;

the movable ring is disposed on an inner side of the rotary ring and the convex points of the movable ring engage with the female threads;

the guide columns are disposed on an end part of the movable ring close to the radiator; the guide columns match with the guide holes of the radiator and are adapted to axially pass through the guide holes; and the convex lens is fixed on the movable ring.

2. The lamp of claim 1, wherein the light source is an LED chip.

3. The lamp of claim 2, wherein the LED chip is fixed on a circuit board and the circuit board is fixed on the radiator;

the lamp further comprises a circuit board cover; and the circuit board cover covers an outer surface of the circuit board and comprises a chip hole.

4. The lamp of claim 1, wherein the limiting structure comprises two pointed screws symmetrically distributed on two sides of the casing.

5. The lamp of claim 1, wherein numbers of the female threads and the convex points are both three; and both the female threads and the convex points are uniformly distributed.

6. The lamp of claim 1, wherein an outer casing is disposed on an outer side of the casing; and the outer casing is provided with torsional spring buckles for installing the lamp.

7. The lamp of claim 6, wherein the torsional spring buckles are symmetrically distributed on an outer side of the outer casing.

8. The lamp of claim 1, wherein numbers of the guide holes and the guide columns are both three; and both the guide holes and the guide columns are uniformly distributed.

9. The lamp of claim 1, wherein the casing, the outer casing, and the radiator are all aluminum materials.

10. The lamp of claim 1, wherein the front cover is anacrylonitrile butadiene styrene (ABS) material.

* * * * *